US006363967B1

(12) United States Patent
Tanaka et al.

(10) Patent No.: US 6,363,967 B1
(45) Date of Patent: Apr. 2, 2002

(54) FLOW MERGING AND DIVIDING DEVICE AND HEAT EXCHANGER USING THE DEVICE

(75) Inventors: Junichirou Tanaka; Masaaki Kitazawa, both of Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/700,042

(22) PCT Filed: May 18, 1999

(86) PCT No.: PCT/JP99/02568

§ 371 Date: Nov. 9, 2000

§ 102(e) Date: Nov. 9, 2000

(87) PCT Pub. No.: WO99/63285

PCT Pub. Date: Dec. 9, 1999

(30) Foreign Application Priority Data

May 29, 1998 (JP) ..... 10-148949

(51) Int. Cl.[7] ..... F28F 9/04; F28F 9/26; F17D 1/00

(52) U.S. Cl. ..... 137/597; 165/144; 165/178; 285/131.1; 137/561 A

(58) Field of Search ..... 165/178, 144; 285/131.1, 125.1, 127.2; 62/262; 137/597, 561 A

(56) References Cited

U.S. PATENT DOCUMENTS 4,126,058 A * 11/1978 Shelby et al. ..... 137/561 A
4,489,721 A * 12/1984 Ozaki et al. ..... 137/597
4,964,950 A * 10/1990 Niskanen et al. ..... 137/597
4,982,572 A * 1/1991 Moore ..... 62/122
5,203,384 A * 4/1993 Hansen ..... 141/59
5,250,041 A * 10/1993 Folden et al. ..... 604/284
5,644,931 A * 7/1997 Ueno et al. ..... 62/612
5,887,907 A * 3/1999 Kubota et al. ..... 285/131.1

FOREIGN PATENT DOCUMENTS

| | | |
|---|---|---|
| JP | 54132842 A * | 10/1979 |
| JP | A-3 7863 | 1/1991 |
| JP | 7 22372 | 4/1995 |
| JP | A-10160288 | 6/1998 |
| JP | A-10170103 | 6/1998 |

* cited by examiner

*Primary Examiner*—Henry Bennett
*Assistant Examiner*—Tho V Duong
(74) *Attorney, Agent, or Firm*—Birch, Stewart, Kolasch & Birch, LLP

(57) ABSTRACT

A flow merging and dividing device, wherein two refrigerant flows move from two inlets (31, 32) located at an inlet part (5) into a merging part (6) for merging, the drift of the two refrigerant flows is eliminated by the merging of the flows at the merging part (6), and the refrigerant flows in which the drift is eliminated by the merging of the flows at the merging part (6) flows out from three outlets (33, 35, 36) located at an outlet part (7), whereby two refrigerant flows can be discharged as three refrigerant flows again from the three outlets (33, 35, 36) after two refrigerant flows are merged so as to eliminate the drift of the two refrigerant flows.

12 Claims, 7 Drawing Sheets

1
2
8
10
31
32
B
1A
1B
1C
1D
1D-1
1E
1E-1
2A
3
3A
41
41A
42
42A
43
45
6
15
16
17
25
26
27

FLOW MERGING AND DIVIDING DEVICE AND HEAT EXCHANGER USING THE DEVICE

This application is the national phase under 35 U.S.C. § 371 of PCT International Application No. PCT/JP99/02568 which has an International filing date of May 18, 1999, which designated the United States of America.

TECHNICAL FIELD

The present invention relates to a flow merging and dividing device which merges a plurality of refrigerant flows and then divides the flow and a heat exchanger using the device.

BACKGROUND ART

As shown in FIG. 6, conventional heat exchangers include the one provided with a flow dividing device 101 to which a refrigerant flows in at the time of evaporation and a flow merging device 102 from which the refrigerant flows out at the time of evaporation. In this heat exchanger, at the time of evaporation, a refrigerant which flows in from the flow dividing device 101 is divided into two paths 103, 105 and the refrigerant is evaporated in each path 103, 105. Then, the two refrigerant flows 106, 107 from the paths 103, 105 are merged at the flow merging device 102 and are allowed to flow out to a refrigerant pipe 108. It is noted that the flow dividing device 101 functions as a flow merging device for merging a refrigerant at the time of condensation and that the flow merging device 102 functions as a flow dividing device for dividing the refrigerant at the time of condensation.

FIG. 7 shows another example of heat exchangers. This heat exchanger is provided with a three-way branched pipe 201 to which a refrigerant flows in at the time of evaporation and a flow merging device 102 from which the refrigerant are discharged at the time of evaporation. In this heat exchanger, the refrigerant which flows in from the three-way branched pipe 201 at the time of evaporation is divided into two paths 203, 205 and the refrigerant is evaporated in each path 203, 205. Then, the two refrigerant flows 206, 207 are merged at the flow merging device 202 and are allowed to flow out to a refrigerant pipe 208. It is noted that the three-way branched pipe 201 functions as a flow merging device for merging a refrigerant at the time of condensation and that the flow merging device 202 functions as a flow dividing device for dividing the refrigerant at the time of condensation.

DISCLOSURE OF THE INVENTION

In the above two examples of conventional heat exchangers, heat exchange efficiency is improved by providing a plurality of refrigerant paths (multiple paths) . However, there is a problem that, if a refrigerant is not appropriately distributed into a plurality of paths depending on the thermal load, refrigerant drift is caused and the evaporating ability is degraded, particularly, in a gas-liquid two-phase flow. This refrigerant drift is caused when the refrigerant is not distributed to each path depending on the thermal load on the air side. In other words, the distribution ratio of a liquid refrigerant at the time of evaporation or a gas refrigerant at the time of condensation does not match the thermal load on the air side.

Also, even when the refrigerant is appropriately distributed to each path depending on the thermal load, the refrigerant cannot be appropriately distributed if the refrigerant flow rate before the division of a flow is changed. This is because the change in the flow rate affects the distribution state of the refrigerant.

Thus, it can be suggested that an orifice should be provided to accelerate the flow so that the change of the distribution state is prevented. In this case, however, there is a problem that pressure loss increases and refrigerant collision noises occur.

Accordingly, an object of the present invention is to provide a flow merging and dividing device capable of distributing a refrigerant to a plurality of refrigerant flow paths appropriately at all times to maximize its heat exchanging ability and a heat exchanger using the device.

In order to achieve the above, object, there is provided a heat exchanger having flow merging and dividing means for merging a refrigerant flowing in a plurality of refrigerant flow paths and then dividing the refrigerant to another plurality of refrigerant flow paths.

This heat exchanger has flow merging and dividing means for merging the refrigerant flows which move in a plurality of refrigerant flow paths and then dividing into another plurality of refrigerant flow paths. Therefore, the refrigerant can be distributed to another plurality of refrigerant flow paths appropriately at all times after refrigerant drift is eliminated by the flow merging and dividing means, and thereby the heat exchanging ability of the heat exchanger can be maximized.

Also, there is provided a flow merging and dividing device comprising: an inlet part having a plurality of inlets; a merging part in which a plurality of refrigerant flows from the plurality of inlets are merged; and an output part having a plurality of outlets to which the refrigerant flows in from the merging part.

In this flow merging and dividing device, a plurality of refrigerant flows move in from a plurality of inlets of the inlet part into the merging part so as to merge. Drift of the plurality of refrigerant flows is eliminated by this merge at the merging part. Then, the refrigerant flows which have been merged at the merging part to eliminate the drift are discharged from a plurality of outlets of the outlet part. That is, according to this flow merging and dividing device, after a plurality of refrigerant flows are merged and the drift is eliminated, the refrigerant can be discharged from a plurality of outlets as a plurality of refrigerant flows again. Therefore, the refrigerant can be distributed to a plurality of paths appropriately at all times to maximize the ability of the heat exchanger by using the flow merging and dividing device of the present invention.

In one embodiment of the present invention, at least an inlet and an outlet are not opposed to each other.

Since at least an inlet and an outlet are not opposed to each other in this flow merging and dividing device, a refrigerant drifted from the inlet is prevented from passing through the merging part and flowing out of the outlet as drift. A plurality of refrigerant flows can be reliably merged at the merging part and the drift of the refrigerant flows can be reliably eliminated.

In one embodiment of the present invention, the flow merging and dividing device further comprises: merging paths for smoothly merging a plurality of refrigerant flows from the plurality of inlets and dividing paths for smoothly dividing the refrigerant from the merging part toward a plurality of outlets.

In this flow merging and dividing device, the merging paths are used to merge a plurality of refrigerant flows from a plurality of inlets smoothly and guide them to the merging part. The dividing paths are used to divide the refrigerant from the merging part smoothly towards a plurality of outlets. Therefore, according to this flow merging and dividing device, the drift of the refrigerant can be prevented without causing any pressure loss. Thus, the ability of the heat exchanger can be further improved.

Also, there is provided a heat exchanger, wherein a plurality of refrigerant flow paths are connected to a plurality of inlets of the flow merging and dividing device and another plurality of refrigerant flow paths are connected to a plurality of outlets of the flow merging and dividing device.

In this heat exchanger, a plurality of refrigerant flows move in from a plurality of refrigerant flow paths into the flow merging and dividing device and the drift is eliminated in this flow merging and dividing device. Therefore, the refrigerant can be distributed from this flow merging and dividing device to another plurality of refrigerant flow paths appropriately at all times, and thereby the heat exchanging ability can be maximized.

BEST MODE FOR CARRYING OUT THE INVENTION

Embodiments of the flow merging and dividing device of the present invention will be described in detail below with reference to drawings.

First Embodiment

Figures 1A, 1B, 1C, 1D:
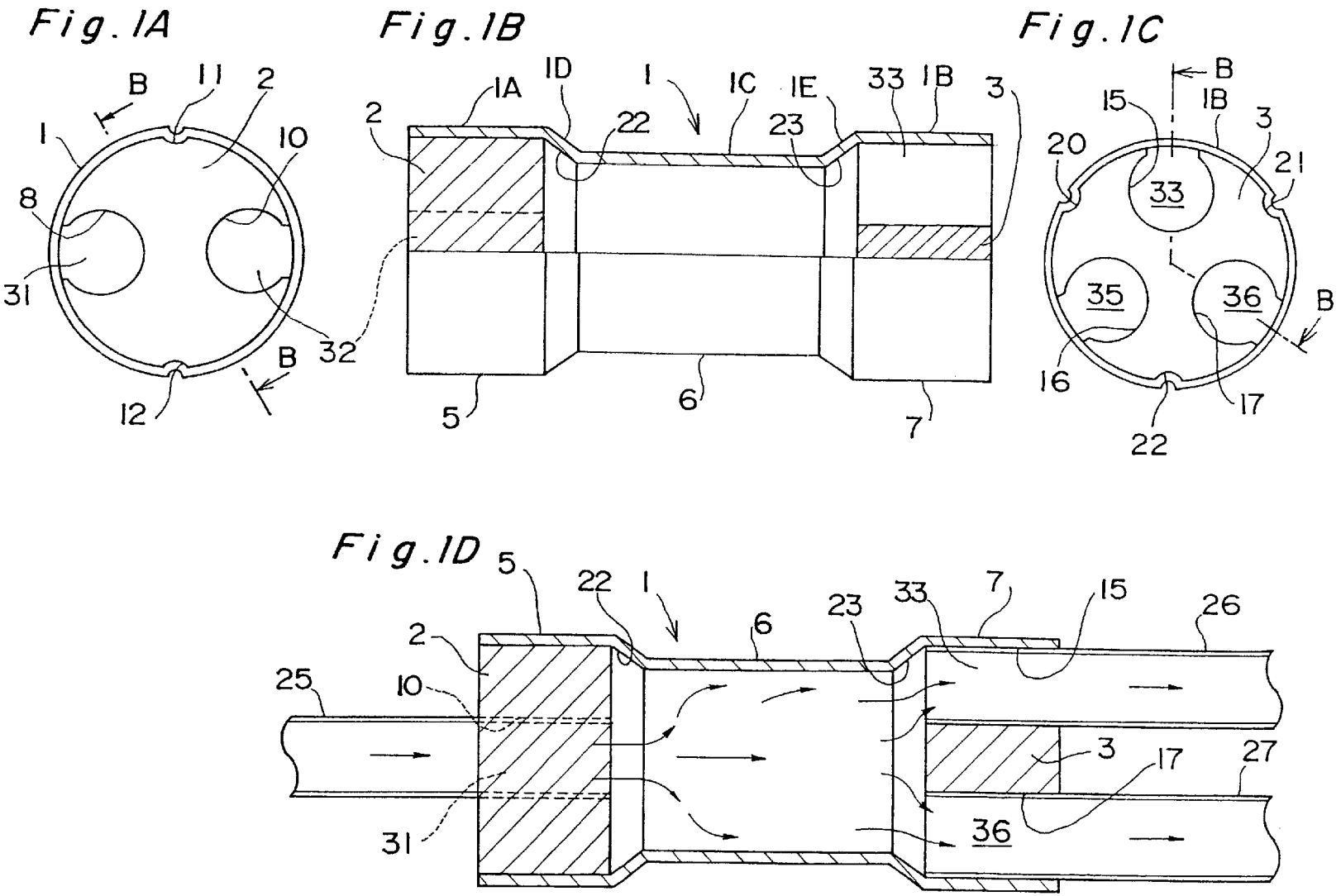
FIG. 1A is a view showing an axial end surface of a flow merging and dividing device according to a first embodiment of the invention.
FIG. 1B is a view showing a half cross section of the first embodiment.
FIG. 1C is a view showing the other end surface of the first embodiment.
FIG. 1D is a sectional view showing a state that branch pipes are connected to the first embodiment.

FIG. 1 shows a first embodiment of the flow merging and dividing device of the present invention. As shown in FIG. 1B, this flow merging and dividing device is constituted such that branch pipe connecting members 2, 3 are internally engaged to both axial end parts 1A, 1B of a cylindrical-shape outer pipe 1 made of copper of which approximate central part in the axial direction is slightly constricted. The end part 1A of the outer pipe 1 and the branch pipe connecting member 2 constitute an inlet part 5. The central part 1C of the outer pipe 1 constitutes a merging part 6. The end part 1B of the outer pipe 1 constitutes an outlet part 7. Parts 1D, 1E widening from the central part 1C of the outer pipe 1 towards the end parts 1A, 1B constitute a merging path 22 and a dividing path 23.

As shown in FIG. 1A, the branch pipe connecting member 2 has two axial through trenches 8, 10. These two through trenches 8, 10 are disposed 180° off each other in the circumferential direction. The through trenches 8, 10 constitute two inlets. The branch pipe connecting member 2 is fixed to the outer pipe 1 by riveting an outer periphery of the end part 1A of the outer pipe 1 at two sites 11, 12 on the outer peripheral surface which are disposed 90° off the two through trenches 8, 10.

As shown in FIG. 1C, the branch pipe connecting member 3 has three axial through trenches 15, 16, 17. These three axial through trenches 15, 16, 17 are disposed 120° off each other. The through trenches 15, 16, 17 constitute three outlets. The branch pipe connecting member 3 is fixed to the outer pipe 1 by riveting an outer periphery of the end part 1B of the outer pipe 1 at three Asites 20, 21, 22 on the outer peripheral surface which are 60° off the three through trenches 15, 16, 17. As evident in FIGS. 1A and 1C, the through trenches 8, 10 of the inlet part 5 are not opposed to the through trenches 15, 16, 17 of the outlet part 7, but their positions are off each other in the circumferential direction.

As shown in FIG. 1D, a branch pipe 25 is internally engaged to the through trench 10 of the branch pipe connecting member 2 in the inlet part 5 as a refrigerant pipe. Another branch pipe having the same structure as that of this branch pipe 25 is internally engaged to the other through trench 8 though it is not shown in the figure. On the other hand, branch pipes 26, 27 are internally engaged to the through trenches 15, 17 of the branch pipe connecting member 3 in the outlet part 7 as refrigerant pipes. Another branch pipe having the same structure as that of the branch pipes 26, 27 is internally engaged to the other through trench 16 as a refrigerant pipe though it is not shown in the figure.

In the flow merging and dividing device constituted as described above, two refrigerant flows move from two inlets 31, 32 of the inlet part 5 into the merging part 6 and merge. The drift of the two refrigerant flows is eliminated by this merge at the merging part 6. Then, refrigerant flows which have been merged to eliminate the drift at the merging part 6 are discharged from three outlets 33, 35, 36 of the outlet part 7. That is, according to this flow merging and dividing device, after the two refrigerant flows are merged and the drift is eliminated, the refrigerant can be discharged from three outlets 33, 35, 36 as three refrigerant flows again without any drift. Therefore, a heat exchanger having an enhanced heat exchanging ability which can distribute the refrigerant to a plurality of paths appropriately at all time can be constituted by using this flow merging and dividing device.

Also, since the two inlets 31, 32 are not opposed to the three outlets 33, 35, 36 in this flow merging and dividing device, the refrigerant flows drifted from the inlets 31, 32 are prevented from passing through the merging part 6 and flowing out of the outlets 33, 35, 36 as drift. Therefore, the two refrigerant flows can be reliably merged at the merging part 6 and the drift of the refrigerant flows can be reliably eliminated.

Also, in this flow merging and dividing device, the merging path 22 can be used to merge two refrigerant flows from the two inlets 31, 32 smoothly and guide them to the merging part 6. The dividing path 23 can be used to divide the refrigerant from the merging part 6 toward three outlets 33, 35, 36 smoothly. Thus, according to this flow merging and dividing device, the drift of the refrigerant can be prevented without causing any pressure loss, and thereby the ability of the heat exchanger can be further improved.

Second Embodiment

FIG. 2 shows a second embodiment of the flow merging and dividing device of the present invention. The second embodiment is different from the first embodiment shown in FIG. 1 only in the next point (i).

Figures 2A, 2B, 2C, 2D, 2E:
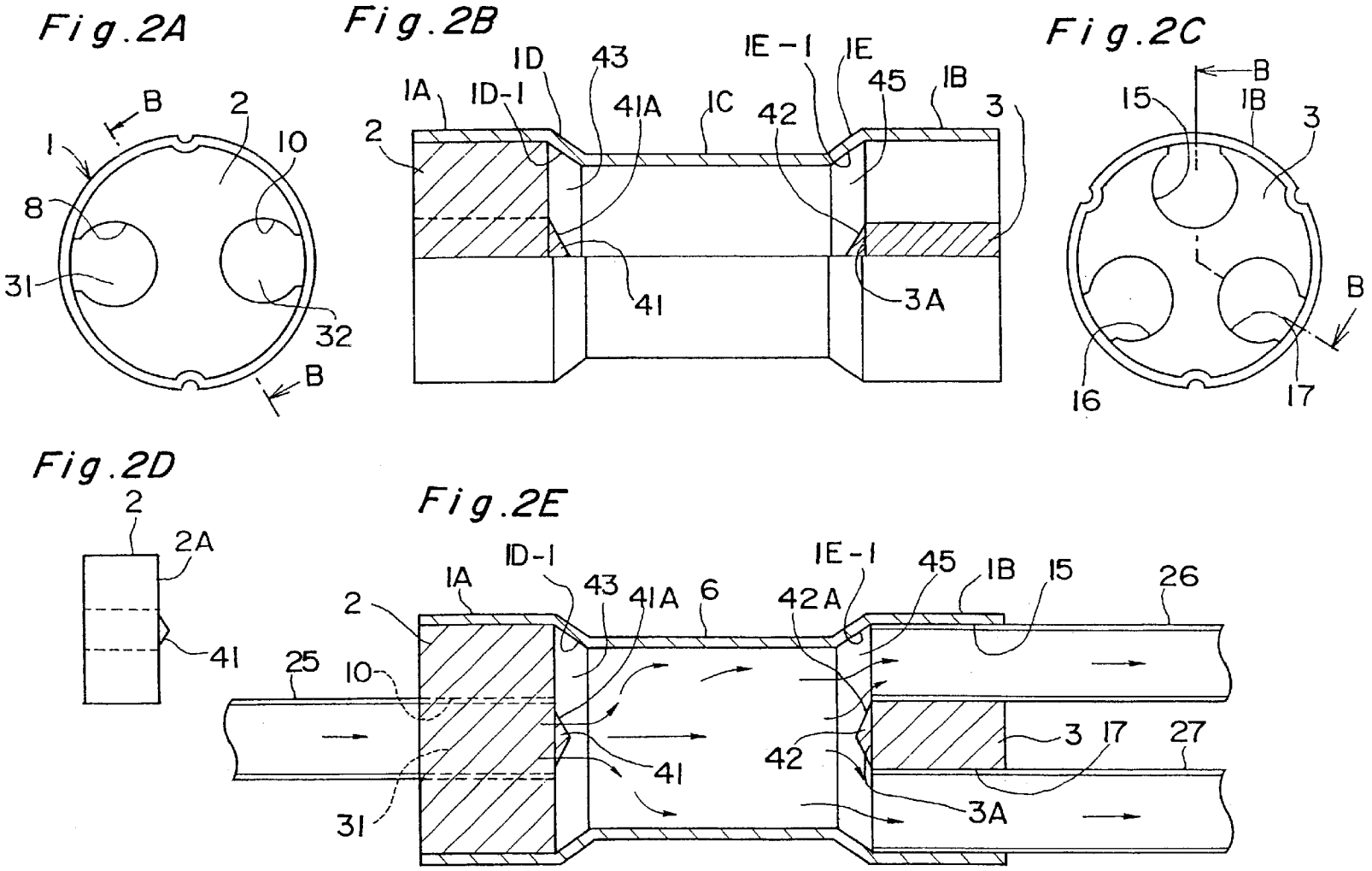
FIG. 2A is a view showing an axial end surface of a flow merging and dividing device according to a second embodiment of the invention.
FIG. 2B is a view showing a half cross section of the second embodiment.
FIG. 2C is a view showing the other end surface of the second embodiment.
FIG. 2D is a view showing a side surface of a branch pipe connecting member of the second embodiment.
FIG. 2E is a sectional view showing a state that branch pipes are connected to the second embodiment.

(i) As shown in FIGS. 2B, 2D and 2E, a protruded part 41 in a conical shape is formed in the approximate central part of an axial end surface 2A of a branch pipe connecting member 2. Also, a protruded part 42 in a conical shape is formed in an approximate central part of an axial end surface 3A of a branch pipe connecting member 3. The axial dimension of the protruded parts 41, 42 is smaller than the axial dimension of a merging path 22 and the dividing path 23.

According to the second embodiment, a tapered surface 41A of the protruded part 41 and a tapered surface 1D-1 of a part 1D widening toward the end constitute a merging path 43. A tapered surface 42A of the protruded part 42 and a tapered surface 1E-1 of a part 1E widening toward the end constitute a dividing path 45. As is evident from comparison between FIG. 1D and FIG. 2E, according to the merging path 43 the second embodiment, the tapered surface 41A can be utilized to merge inflow refrigerant flows more smoothly than the merging path 22 of the first embodiment. Also, according to the dividing path 45, the tapered surface 42A can be utilized to divide the merged refrigerant more smoothly than the dividing path 23 of the first embodiment. Therefore, according to the second embodiment, pressure loss can be further decreased and a more efficient heat exchanger can be constituted compared with the first embodiment.

The branch pipes 25, 26, 27 are insert and soldered to the branch pipe connecting members 2, 3 in the above first and second embodiments. It is noted, however, that three holes 302A and two holes 303A may be formed in end walls 302, 303, respectively, of both axial ends of a cylindrical member 301 as shown in FIG. 5C. Three branch pipes 305 communicating with the three holes 302A of the end wall 302 may be welded to the end wall 302 and two branch pipes 306 communicating with the two holes 303A of the end wall 303 may be welded to the end wall 303.

Figure 5A:
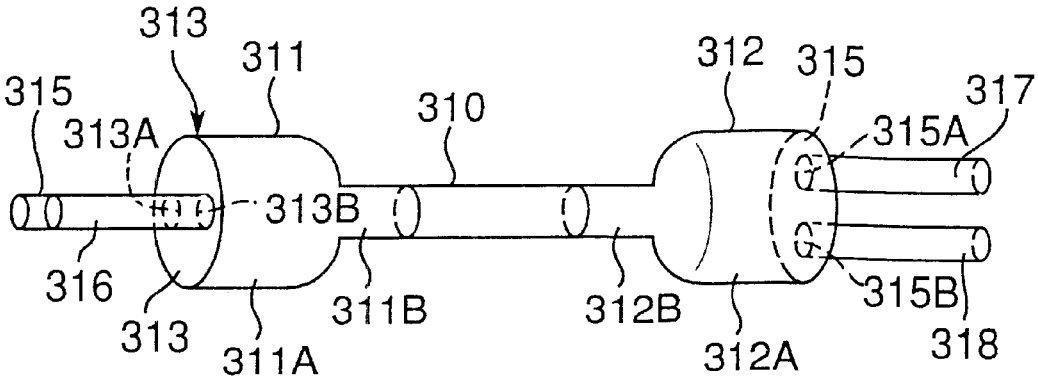
FIG. 5A is a schematic view showing a modification of the flow merging and dividing device of the invention.

Also, flow dividing devices 311, 312 may be connected to both ends of a connecting pipe 310 to constitute a flow merging and dividing device 313 as shown in FIG. 5A. The flow dividing devices 311, 312 have a large-diameter part 311A, 312A and a small-diameter part 311B, 312B. The large-diameter part 311A, 312A and the small-diameter part 311B, 312B are connected with a gentle slope. Two branch pipes 315, 316 are connected and communicated with an end surface 313 of the large-diameter part 311A. Other two branch pipes 317, 318 are connected and communicated with an end surface 315 of the large-diameter part 312A. In this flow merging and dividing device 313, the two flow dividing devices 311, 312 and the connecting pipe 310 constitute a merging part and the end surfaces 313, 315 of the flow dividing devices 311, 312 constitute an inlet part and an outlet part, respectively. The communicating holes 313A, 313B of the end surface 313 constitute inlets and the communicating holes 315A, 315B of the end surface 315 constitute outlets. The communicating holes 313A, 313B are not opposed to the communicating holes 315A, 315B.

Figure 5B:
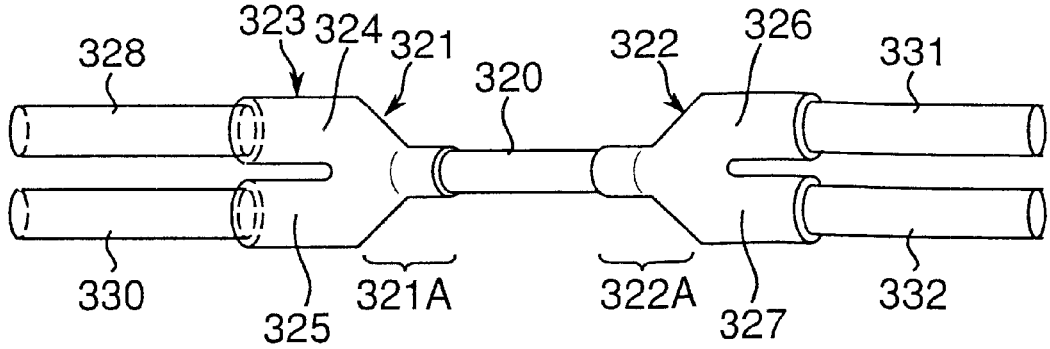
FIG. 5B is a schematic view showing another modification.
Figure 5C:
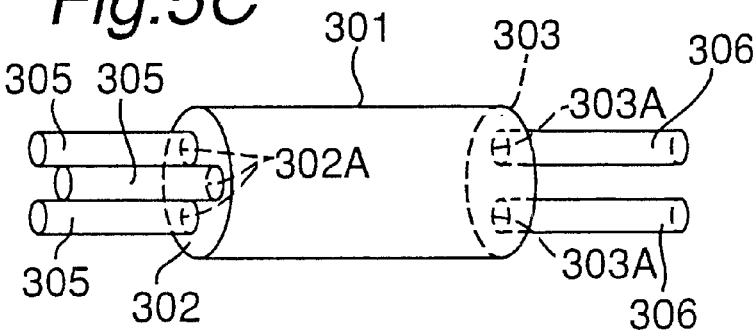
FIG. 5C is a schematic view showing another modification.
Figure 6:
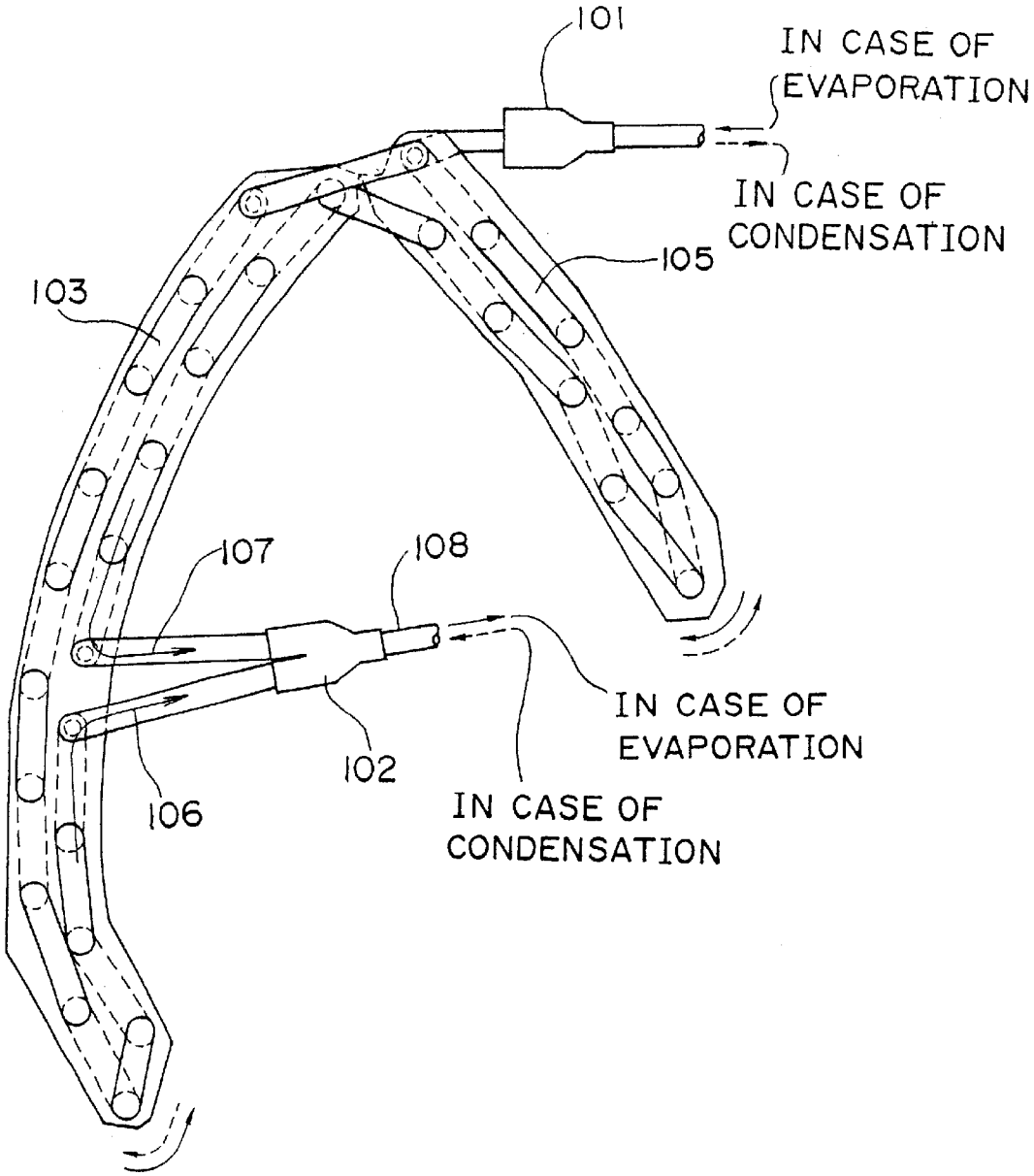
Fig. 6 PRIOR ART
FIG. 6 is a view showing a structure of a conventional heat exchanger.
Figure 7:
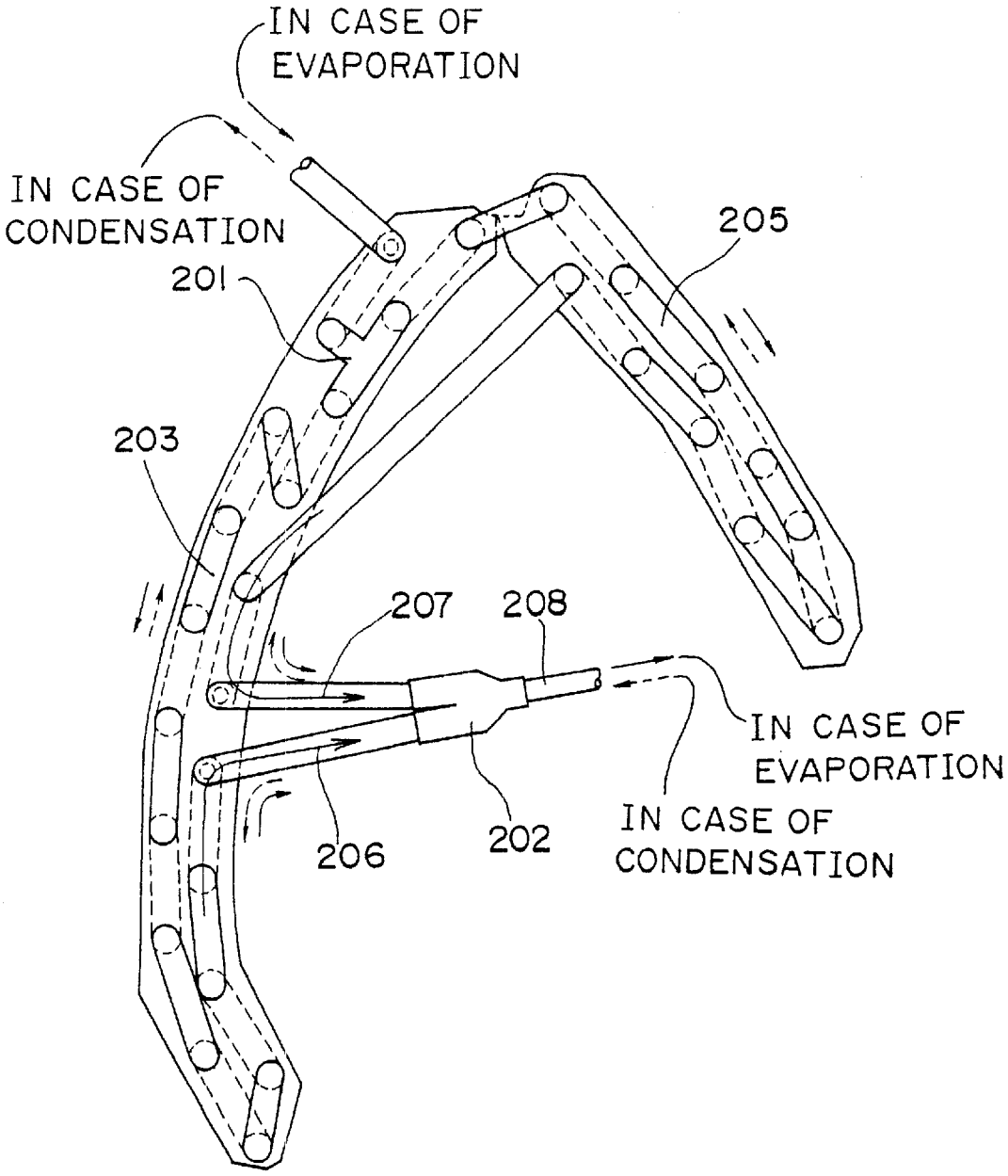
Fig. 7 PRIOR ART
FIG. 7 is a view showing a structure of another conventional heat exchanger.

Further, as shown in FIG. 5B, branched pipes 321, 322 may be connected to both ends of a connecting pipe 320 to constitute a flow merging and dividing device 323. The branched pipes 321, 322 have two branches each, that is, branch parts 324, 325 and branch parts 326, 327. Branch pipes 328, 330 are connected to the branch parts 324, 325 and branch pipes 331, 332 are connected to the branch parts 326, 327. In the flow merging and dividing device 323 of this constitution, base parts 321A, 322A of the branched pipes 321, 322 and a connecting pipe 320 constitute a merging part. The branch parts 324, 325 of the branched pipe 321 constitute an inlet part and the branch parts 326, 327 of the branched pipe 322 constitute an outlet part.

Also, there are three or less inlets or outlets in the above-described flow merging and dividing device, but there may be three or more of these.

Third Embodiment

Figure 3A:
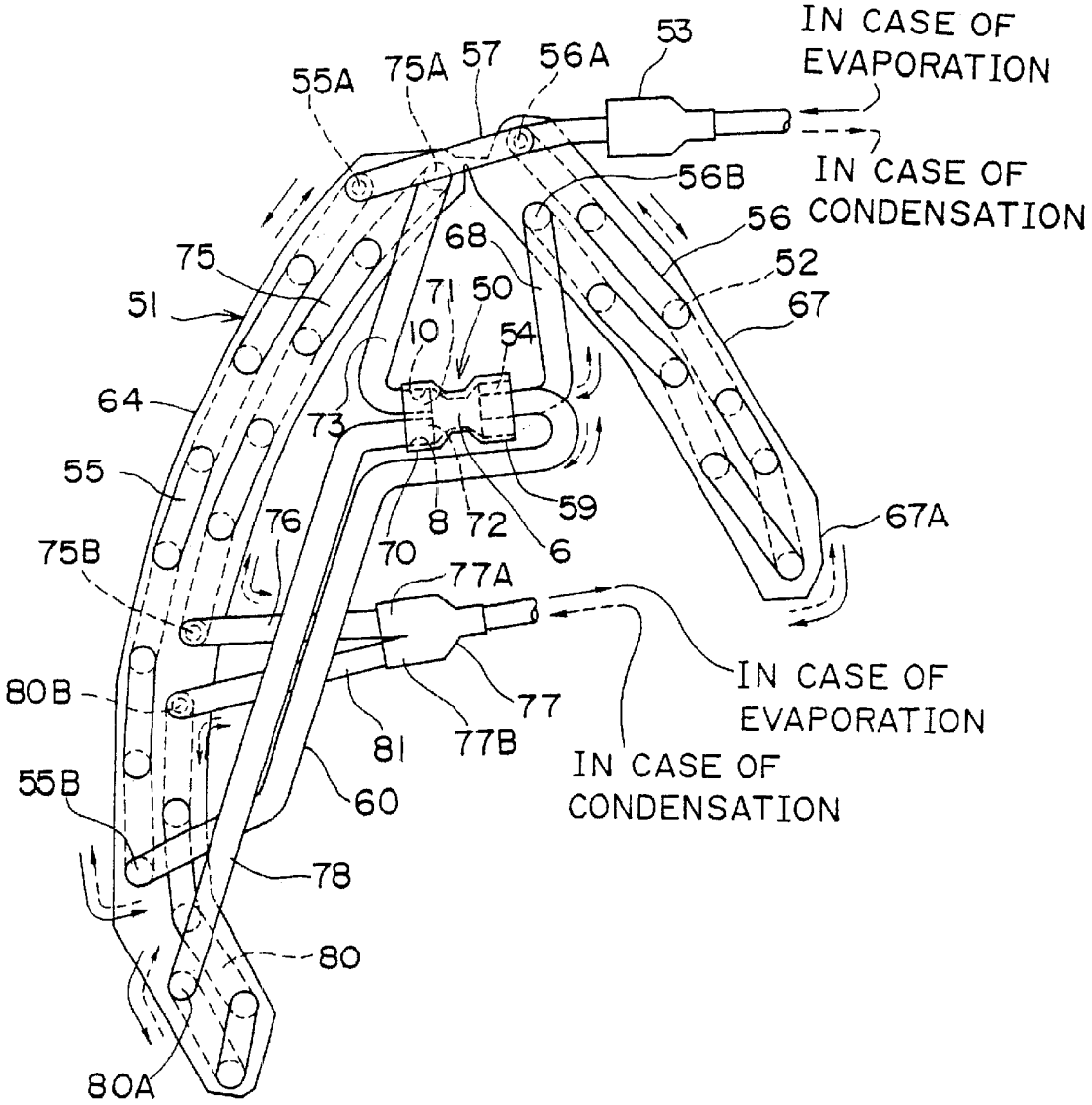
FIG. 3A shows a structure of a heat exchanger according to a third embodiment of the invention.
Figure 3B:
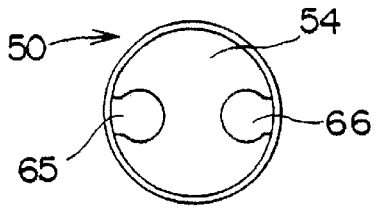
FIG. 3B is an end view showing a flow merging and dividing device in the heat exchanger.

FIG. 3 shows a side view of a heat exchanger according to a third embodiment of the present invention. This heat exchanger uses a flow merging and dividing device 50 using a branch pipe connecting member 54 in the same constitution as the branch pipe connecting member 2 (see FIG. 3B) instead of the branch pipe connecting member 3 in the flow merging and dividing device of the first embodiment. Two through trenches 65, 66 of this branch pipe connecting member 54 are disposed 90° off the two through trenches 8, 10 of the branch pipe connecting member 2 in the circumferential direction.

In this heat exchanger, a plurality of fin plates 51 bent at an acute angle are disposed at predetermined intervals in the direction perpendicular to the plane of the paper. A refrigerant pipe 52 penetrates across the plurality of fin plates 51.

Also, this heat exchanger has a flow dividing device 53. This flow dividing device 53 is connected to one opening 55A of a first refrigerant flow path 55 and one opening 56A of a second refrigerant flow path 56 by a branch pipe 57. The first refrigerant flow path 55 is extended penetrating the plurality of fin plates 51 like a needlework along the outer periphery side of a longer bent part 64 of the fin plate 51. The other opening 55B of the first refrigerant flow path 55 is connected to one inlet 65 of an inlet part 59 of the flow merging and dividing device 50 by a branch pipe 60.

On the other hand, the second refrigerant flow path 56 is extended along the outer periphery side of a shorter bent part 67 of the fin plate 51 and then along the inner periphery side after turning at the end part 67A. The other opening 56B of this second refrigerant flow path 56 is connected to the other inlet 66 of the inlet part 59 of the flow merging and dividing device 50 by a branch pipe 68. This flow merging and dividing device 50 is disposed between the longer bent part 64 and the shorter bent part 67 of the fin plate 51.

An outlet part 70 of the flow merging and dividing device 50 has two outlets 71, 72 constituted by the through trenches 8, 10. The outlet 71 is connected to one opening 75A of a third refrigerant flow path 75 via a branch pipe 73. The third refrigerant flow path 75 is extended along the inner periphery side of the bent part 64 and the other opening 75B located slightly lower than the center of the bent part 64 is connected to one opening 77A of a branched pipe 77 by a branch pipe 76.

The other outlet 72 of the flow merging and dividing device 50 is connected to one opening 80A of a fourth refrigerant flow path 80 via a branch pipe 78. The fourth refrigerant flow path 80 is extended upward along the inner periphery side after turning near the lower end of the bent part 56 and the other opening 80B located slightly lower than the center of the bent part 64 is connected to the other opening 77B of a branched pipe 77 by a branch pipe 81.

According to the heat exchanger constituted as described above, one refrigerant flow moves from the flow dividing device 53 to the first refrigerant flow path 55, the branch pipe 60 and the through trench (inlet) 65 of the flow merging and dividing device 50 at the time of evaporation. The other refrigerant flow from the flow dividing device 53 moves to the second refrigerant flow path 56, the branch pipe 68 and the through trench (inlet) 66 of the flow merging and dividing device 50. These two refrigerant flows are merged at the merging part 6 of the flow merging and dividing device 50 and the drift is eliminated. Subsequently, the refrigerant in the merging part 6 flows from the outlets 71, 72 of the outlet part 70 via the branch pipes 73, 78 and passes through the third refrigerant flow path 75 and the fourth refrigerant flow path 80. Then the refrigerant flows into the openings 77A, 77B of the branched pipe 77 via branch pipes 76, 81.

On the other hand, at the time of condensation, the refrigerant flow from one opening 77A of the branched pipe 77 flows into the outlet 71 of the outlet part 70 via the branch pipe 76, the third refrigerant flow path 75 and the branch pipe 73. The refrigerant flow from the other opening 77B of the branched pipe 77 flows into the outlet 72 of the outlet part 70 via the branch pipe 81, the fourth refrigerant flow path 80 and the branch pipe 78. These two refrigerant flows are merged at the merging part 6 of the flow merging and dividing device 50 and the drift is eliminated. Subsequently, the refrigerant in the merging part 6 flows from the through trenches 65, 66 of the inlet part 59, passes through the branch pipes 60, 68 and then flows into the first and second refrigerant flow paths 55, 56.

Thus, according to the heat exchanger of this embodiment, the drift of the refrigerant from the first and second refrigerant flow paths 55, 56 or the third and fourth refrigerant flow paths 75, 80 can be eliminated by the flow merging and dividing device 50 provided between the first and second refrigerant flow paths 55, 56 and the third and fourth refrigerant flow paths 75, 80. Therefore, the refrigerant can be distributed appropriately at all times to the third and fourth refrigerant flow paths 75, 80 or the first and second refrigerant flow paths 55, 56. Thus, the heat exchanging ability can be maximized.

Fourth Embodiment

Figure 4:
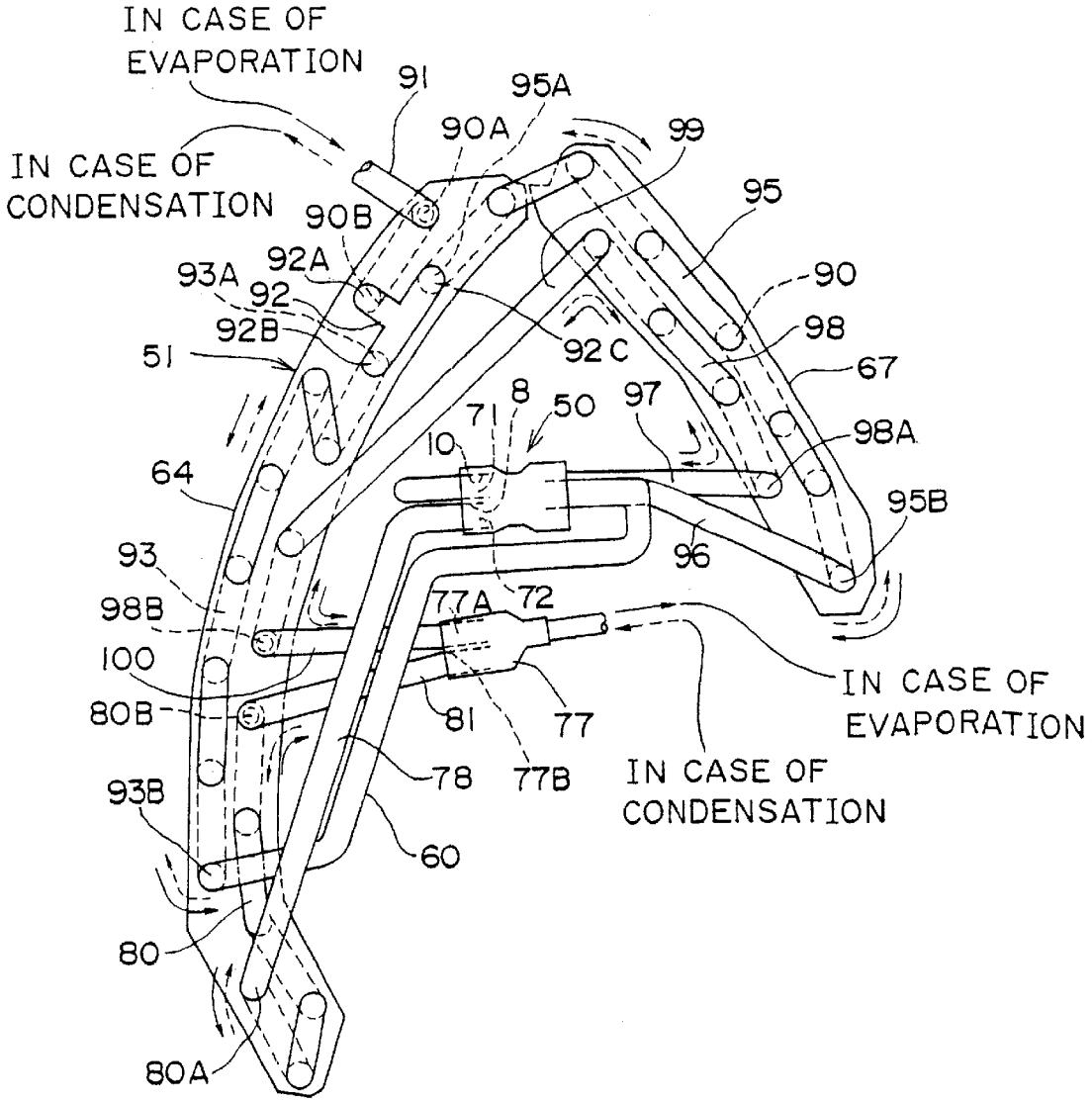
FIG. 4 is a view showing a structure of a heat exchanger according to a fourth embodiment of the invention.

FIG. 4 shows a side view of a heat exchanger according to a fourth embodiment of the present invention. This heat exchanger uses the flow merging and dividing device 50 provided in the third embodiment. Also, this heat exchanger is provided with fin plates 51 provided in the third embodiment. A refrigerant pipe 90 penetrates the fin plates 51 in the direction perpendicular to the plane of the paper.

In this heat exchanger, one opening pipe 91 is connected to one opening 90A of the refrigerant pipe 90 before branching. The other opening 90B of this refrigerant pipe 90 is connected to a first opening 92A of a three-way branched pipe 92. A second opening 92B of the three-way branched pipe 92 is connected to one opening 93A of a first refrigerant flow path 93 and a third opening 92C is connected to one opening 95A of a second refrigerant flow path 95.

The first refrigerant flow path 93 is extended penetrating the plurality of fin plates 51 like a needlework along a longer bent part 64 of the fin plate 51. The other opening 93B of the first refrigerant flow path 93 is connected to one through trench 65 of an inlet part 59 of the flow merging and dividing device 50 by a branch pipe 60. On the other hand, the second refrigerant flow path 95 is extended from the upper end part of the longer bent part 64 of the fin plate 51 over the upper end of a shorter bent part 67 of the fin plate 51 and further along the outer periphery side of this bent part 67. The other opening 95B of this second refrigerant flow path 95 located in the vicinity of the lower end of the shorter bent part 67 is connected to the other through trench 66 of the inlet part 59 of the flow merging and dividing device 50 by a branch pipe 96.

An outlet part 70 the flow merging and dividing device 50 has two outlets constituted by the through trenches 8, 10. The outlet constituted by the through trench 8 is connected to one opening 80A of a third refrigerant flow path 80 via a branch pipe 78. The third refrigerant flow path 80 is extended along the inner periphery side of the bent part 64 and the other opening 80B located slightly lower than the center of the bent part 64 is connected to one opening 77B of a branched pipe 77 by a branch pipe 81.

The other outlet 71 of the flow merging and dividing device 50 is connected to one opening 98A of a fourth refrigerant flow path 98 via a branch pipe 97. The fourth refrigerant flow path 98 is connected to a refrigerant pipe 90 in the vicinity of the center of the bent part 64 by a gangway pipe 99 from the vicinity of the upper end of the bent part 67 and the other opening 98B is connected to the other opening 77A of a branched pipe 77 by a branch pipe 100.

According to the heat exchanger constituted as described above, refrigerant flows divided to the first refrigerant flow path 93 and the second refrigerant flow path 95 can be merged in the flow merging and dividing device 50 at the time of evaporation. Then, the refrigerant flow of which drift has been eliminated by this merge can be divided to the third refrigerant flow path 80 and the fourth refrigerant flow path 98. On the other hand, at the time of condensation, the refrigerant flows divided to the third refrigerant flow path 80 and the fourth refrigerant flow path 98 can be merged in the flow merging and dividing device 50. Then, the refrigerant flow of which drift has been eliminated by this merge can be divided to the first refrigerant flow path 93 and the second refrigerant flow path 95.

Thus, according to this embodiment, the drift of the refrigerant from the first and second refrigerant flow paths 93, 95 or the third and fourth refrigerant flow paths 80, 98 can be eliminated by the flow merging and dividing device 50. Therefore, the refrigerant can be distributed appropriately at all times to the third and fourth refrigerant flow paths 80, 98 or the first and second refrigerant flow paths 93, 95. Thus, the heat exchanging ability can be maximized.

It is noted that the present invention can be applied in a heat exchanger of outdoor equipment although the heat exchangers of indoor equipment are described in the third and fourth embodiments.

INDUSTRIAL APPLICABILITY

The present invention can be applied to a heat exchanger having a plurality of refrigerant flow paths and is useful in distributing a refrigerant to the plurality of refrigerant flow paths appropriately at all times to maximize the heat exchanging ability.

What is claimed is:

1. A flow merging and dividing device comprising:

an outer pipe, said outer pipe including a first end and a second end;

an inlet portion having a plurality of inlets, said inlet portion constituting said first end and a first branch pipe connecting member;

a merging portion for merging a plurality of refrigerant flows from said plurality of inlets; and an output portion having a plurality of outlets, said output portion constituting said second end and a second branch pipe connecting member, wherein said refrigerant flows out from said merging portion and into said output portion.

2. The flow merging and dividing device according to claim 1, wherein said plurality of inlets and said plurality of outlets are not opposed to each other.

3. The flow merging and dividing device according to claim 1, wherein said first branch pipe connecting member further comprises two axial through trenches.

4. The flow merging and dividing device according to claim 3, wherein said through trenches are disposed 180° from each other in a circumferential direction.

5. The flow merging and dividing device according to claim 4, wherein said through trenches constitute two inlets.

6. The flow merging and dividing device according to claim 1, wherein said second branch pipe connecting member further comprises three axial through trenches.

7. The flow merging and dividing device according to claim 6, wherein said through trenches are disposed 120° from each other in a circumferential direction.

8. The flow merging and dividing device according to claim 7, wherein said through trenches constitute three outlets.

9. The flow merging and dividing device according to claim 1, wherein said first and second branch pipe connecting members are fixed to said first and second ends by riveting an outer periphery of the outer pipe.

10. The flow merging and dividing device according to claim 1, further comprising:

merging paths for smoothly merging said plurality of refrigerant flows from said plurality of inlets; and dividing paths for smoothly dividing the refrigerant from said merging portion toward said plurality of outlets.

11. The flow merging and dividing device according to claim 10, wherein said merging paths further comprise a protruded part, said protruded part is conical in shape and formed approximately in a central portion of said first branch pipe connecting member.

12. The flow merging and dividing device according to claim 10, wherein said dividing paths further comprise a protruded part, said protruded part is conical in shape and formed approximately in a central portion of said second branch pipe connecting member.

* * * * *